US007222629B1

(12) United States Patent
Han

(10) Patent No.: US 7,222,629 B1
(45) Date of Patent: May 29, 2007

(54) APPARATUS FOR SECURING AN EYELASH HOLDER PLATFORM TO A BACK OF A BEAUTICIAN'S HAND

(76) Inventor: Yongho Han, 8 Clearmeadow Ct., Woodbury, NY (US) 11797

( * ) Notice: Subject to any disclaimer, the term of this patent is extended or adjusted under 35 U.S.C. 154(b) by 429 days.

(21) Appl. No.: 10/853,688

(22) Filed: May 25, 2004

(51) Int. Cl.
*A45D 40/30* (2006.01)
*A45D 44/00* (2006.01)

(52) U.S. Cl. ..... 132/216; 132/333

(58) Field of Classification Search ..... 132/216, 132/333; 224/217; 433/49, 163; 206/63.5; 248/74.1, 74.3, 309.1, 309.2; 211/65, 70.6, 211/70.7
See application file for complete search history.

(56) References Cited

U.S. PATENT DOCUMENTS 2,154,336 A * 4/1939 King ..... 132/139
4,631,783 A * 12/1986 Hayashi ..... 24/16 PB
4,646,953 A 3/1987 Marshall et al.
5,743,500 A 4/1998 Northway et al.
5,772,163 A 6/1998 Young

* cited by examiner

*Primary Examiner*—Robyn Doan
(74) *Attorney, Agent, or Firm*—Richard L. Miller

(57) ABSTRACT

When securing eyelashes to a user's eyelid the procedure is greatly simplified and facilitated if the beautician applying the eyelash has both hands free when applying adhesive glue to an eyelash and then placing the eyelash on the user's eyelid. Rather than having an eyelash holder platform of eyelashes standing free on a work table the task is greatly simplified and made much easier if the eyelash holder platform is kept handy and easily accessible to the beautician by temporarily attaching the eyelash holder platform to the back of the beauticians hand. Accordingly an apparatus for securing an eyelash holder platform to a back of a beautician's hand which has a finger ring, which is removably attachable to an eyelash holder platform, and is to be worn on a beautician's finger so as to maintain the location of the platform in the proximity of the back of the beautician's hand.

1 Claim, 1 Drawing Sheet

APPARATUS FOR SECURING AN EYELASH HOLDER PLATFORM TO A BACK OF A BEAUTICIAN'S HAND

BACKGROUND OF THE INVENTION

1. Field of the Invention

The present invention relates to apparatus for facilitating and simplifying the process of applying false eyelashes to the eye lids of a person.

2. Description of the Prior Art

Numerous innovations for facilitating the applying of various material for various processes have been provided in the prior art that will be described. Even though these innovations may be suitable for the specific individual purposes to which they address, accordingly they differ from the present invention.

A FIRST EXAMPLE, U.S. Pat. No. 4,646,953 to Marshall et al teaches a resilient, V-shaped clamp for support between a person's fingers; the clamp including a toothed pad to grip around a nail polish bottle, and including finger supporting tabs.

A SECOND EXAMPLE, U.S. Pat. No. 5,743,500 to Northway et at teaches a method and apparatus for holding bottles, especially fingernail polish bottles, in such manner that tipping and spillage is virtually impossible, featuring a padded strap-like apparatus which can be laid flat on a surface or draped over an object in such manner that an attached bottle holder featuring a pierced and serrated diaphragm in which a bottle is placed will remain in alignment with the bottle upright at all times.

A THIRD EXAMPLE, U.S. Pat. No. 5,772,163 to Young teaches a device for holding and selectively tipping a container of a liquid into which an implement, such as a brush, is periodically inserted, for removing a portion of the liquid contents, includes a base to be placed on a surface, a receptacle for holding the container, and a hinge joining the receptacle to the base substantially along a side of the receptacle adjacent the base when the receptacle is in upright position on the base. The receptacle can be rotated or tipped about the hinge means to tip the container held in the receptacle. The tension on the hinge is preferably adjustable to adjust the resistance to rotational movement of the hinge. The receptacle is preferably lined with a resilient and compressible material such as plastic foam so that containers of various shapes and sizes may be inserted into the receptacle and held by compressed material.

SUMMARY OF THE INVENTION

AN OBJECT of the present invention is to provide an apparatus for securing an eyelash holder platform to a back of a beautician's hand that avoids the disadvantages of the prior art.

ANOTHER OBJECT of the present invention is to provide an apparatus for securing an eyelash holder platform to a back of a beautician's hand that is simple and inexpensive to manufacture.

STILL ANOTHER OBJECT of the present invention is to provide an apparatus for securing an eyelash holder platform to a back of a beautician's hand that is simple to use.

BRIEFLY STATED, STILL YET ANOTHER OBJECT of the present invention is to provide an apparatus for securing an eyelash holder platform to a back of a beautician's hand which has a finger ring, which is removably attachable to an eyelash holder platform, and is to be worn on a beautician's finger so as to maintain a location of the platform in the proximity of the back of the beautician's hand. When applying eyelashes to a user's eyelid the procedure is greatly simplified and facilitated and saves time if the beautician applying the eyelash has both hands free to when applying adhesive glue to an eyelash and then placing the eyelash on the user's eyelid. Rather than having an eyelash holder platform of eyelashes standing free on a work table the task is greatly simplified and made much easier if the eyelash holder platform is kept handy and easily accessible to the beautician by temporarily attaching the eyelash holder platform to the back of the beautician's hand.

Accordingly with this purpose as a motive a finger ring which can be worn preferably on the middle finger of the beautician has a sawtooth rack projection integrally formed therewith, which cooperates with a mating opening centrally located in the eyelash holder platform and permits the beautician to remove and utilize eyelashes as needed from the eyelash holder platform and appropriately secure the eyelashes to a user's eye lid.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIG. 4 is an enlarged diagrammatic perspective view of the opening in an eyelash platform before a sawtooth rack projection of the device has been inserted through.

A MARSHALLING OF REFERENCE NUMERALS UTILIZED IN THE DRAWING

Figure 1:
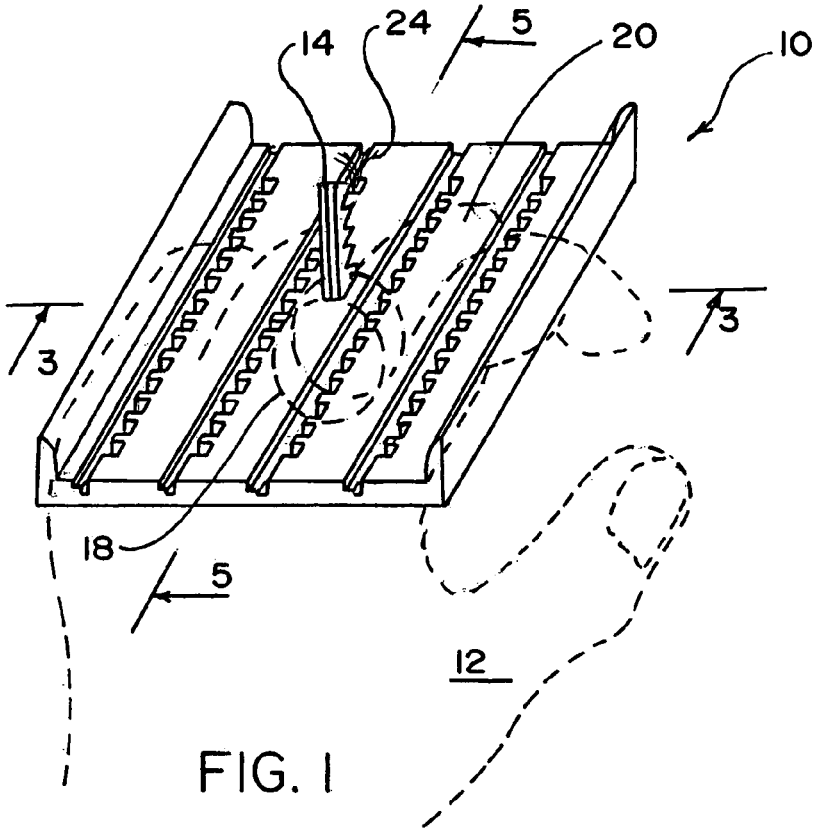
FIG. 1 is a diagrammatic perspective view illustrating the present invention installed and ready for use on the back of a beautician's hand.

10 eyelash holder platform
12 beautician's hand
14 sawtooth rack projection
16 opening
18 securement finger ring
20 middle finger
22 plurality of teeth
24 false eyelash
26 base
28 tab member

DETAILED DESCRIPTION OF THE PREFERRED EMBODIMENT

Figure 2:
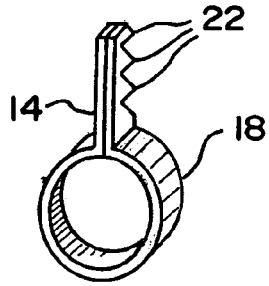
FIG. 2 is a diagrammatic perspective view of a securement finger ring device per se.

Referring now to the figures, in which like numerals indicate like parts, and particularly to FIG. 1, which illustrates an eyelash holder platform 10 attached to the back of a beautician's hand 12 by a sawtooth rack projection 14 that has been inserted through an opening 16 located centrally in the eyelash holder platform 10. As best seen in FIG. 2, the sawtooth rack projection 14, which has a plurality of teeth 22, is integrally formed with a securement finger ring 18 which is preferably worn on the middle finger 20 of the beautician's hand 12.

Figure 3:
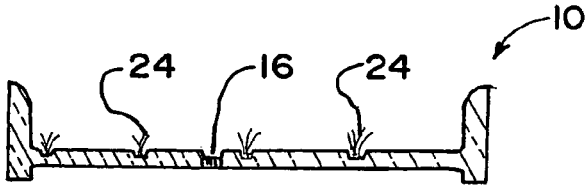
FIG. 3 is a cross sectional view taken on line 3—3 of FIG. 1 before the ring finger securement device has been inserted therein.
Figure 4:
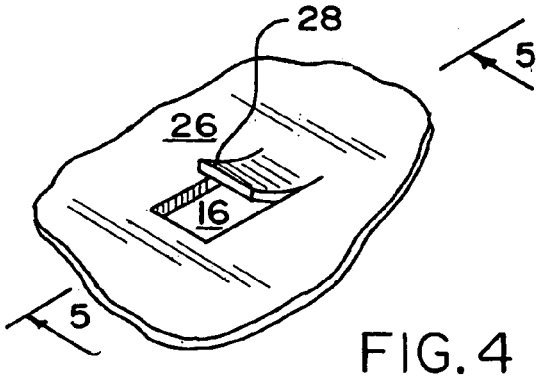
Figure 5:
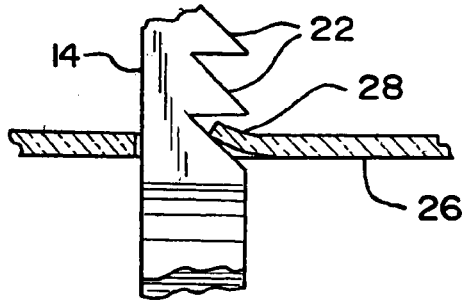
FIG. 5 is a diagrammatic cross sectional view, with parts broken away, taken on line 5—5 of FIG. 4, with the sawtooth rack projection removed for clarity, and also taken on line 5—5 of FIG. 1 showing the sawtooth rack projection engaging the opening of the eyelash platform.

When the device is donned on the back of a beautician's hand the securement finger ring 18 is placed on the beautician's middle finger 20 and the sawtooth rack projection 14 is forced through the opening 16 located centrally in the eyelash holder platform 10 which is pre loaded with false eyelashes 24, as seen in FIG. 3, ready for securement to a user's eye lids. As best seen in FIGS. 4 and 5, when the sawtooth rack projection 14 is forced into the opening 16 in a forward direction through base 26 of the eyelash holder platform 10, a tab member 28, integrally formed with the base 26, which is resilient, flexibly engages the teeth 22 of the sawtooth rack projection 14, so that the eyelash holder platform 10 is removably impaled upon the sawtooth rack projection 14, and accordingly held in place.

In order to remove the eyelash holder platform 10 from the sawtooth rack projection 14 sufficient pulling force must be applied to the platform to flex the tab member 28 past the saw teeth in a reverse direction.

Using the eyelash holder platform 10 the procedure for applying eyelashes is greatly be simplified and accordingly facilitates the saving of time for the beautician applying adhesive glue to an eyelash and then placing the eyelash on the user's eyelid.

It should be appropriately noted that the eyelash holder platform 10 allows for the beautician's one hand that the device is secured onto to do something else freely while placing the eyelash on the user's eyelid, rather than only for holding an eyelash platform.

It will be understood that each of the elements described above, or two or more together, may also find a useful application in other types of constructions differing from the types described above.

While the invention has been illustrated and described as embodiments of an apparatus for securing an eyelash holder platform to a back of a beautician's hand, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An apparatus for securing an eyelash holder platform to a back of a beautician's hand comprising:

a) an eyelash holder platform having a base with a centrally located opening; and b) a sawtooth rack projection, which cooperates with said centrally located opening;

wherein a tab member, is located in said centrally located opening, and integrally formed with the base;

wherein sawtooth rack projection has a plurality of teeth;

wherein said tab member is resilient and flexibly engages said plurality of teeth of the sawtooth rack projection;

wherein said a sawtooth projection is integrally formed with a securement finger ring; and wherein said eyelash holder platform is pre-loaded with false eyelashes.

* * * * *